US012330013B2

(12) United States Patent
Andresen

(10) Patent No.: US 12,330,013 B2
(45) Date of Patent: Jun. 17, 2025

(54) HANDSTAND TRAINING DEVICE

(71) Applicant: ProHandstand, LLC, Sheridan, WY (US)

(72) Inventor: Heddies Andresen, Quickborn (DE)

(73) Assignee: ProHandstand, LLC, Sheridan, WY (US)

( * ) Notice: Subject to any disclaimer, the term of this patent is extended or adjusted under 35 U.S.C. 154(b) by 230 days.

(21) Appl. No.: 17/788,921

(22) PCT Filed: Dec. 29, 2020

(86) PCT No.: PCT/DE2020/101087
§ 371 (c)(1),
(2) Date: Jun. 24, 2022

(87) PCT Pub. No.: WO2021/139851
PCT Pub. Date: Jul. 15, 2021

(65) Prior Publication Data

US 2022/0355157 A1 Nov. 10, 2022

(30) Foreign Application Priority Data

Jan. 7, 2020 (DE) ..... 10 2020 100 161.4

(51) Int. Cl.
*A63B 21/00* (2006.01)
*A63B 69/00* (2006.01)

(52) U.S. Cl.
CPC ..... *A63B 21/4035* (2015.10); *A63B 69/0057* (2013.01); *A63B 2208/028* (2013.01); *A63B 2225/093* (2013.01)

(58) Field of Classification Search
CPC ..... A63B 21/0005; A63B 21/00054; A63B 21/068; A63B 21/4035; A63B 69/0057; A63B 2208/028; A63B 2225/093
See application file for complete search history.

(56) References Cited

U.S. PATENT DOCUMENTS 1,348,110 A * 7/1920 Hasskarl ..... A63B 25/00 482/76
2,919,918 A * 1/1960 Horn ..... A63B 21/00054 482/142
2,939,704 A * 6/1960 Pond ..... A63B 21/00047 482/23
3,114,545 A * 12/1963 Horn ..... A63B 21/00054 482/142

(Continued)

FOREIGN PATENT DOCUMENTS

DE 2724452 A1 12/1978
DE 2736839 A1 3/1979

(Continued)

OTHER PUBLICATIONS

International Search Report from PCT International Application No. PCT/DE2020/101087, dated Apr. 9, 2021.

*Primary Examiner* — Joshua Lee
(74) *Attorney, Agent, or Firm* — Budzyn IP Law, LLC

(57) ABSTRACT

The invention relates to a handstand training device (10, 100). In order for the user (50) to learn how to do a handstand and to be able to hold the handstand without using any device afterwards, the handstand training device (10) has a base element (11, 111) and a support element (13) with a contact surface (14) for an arm (52).

11 Claims, 4 Drawing Sheets

(56) References Cited

U.S. PATENT DOCUMENTS

| | | | | | |
|---|---|---|---|---|---|
| 3,173,415 | A * | 3/1965 | Rubin | A63B 21/023 | 482/142 |
| 3,667,755 | A * | 6/1972 | Manning | A63B 25/00 | 482/76 |
| 3,879,033 | A * | 4/1975 | Martin | A63B 21/00047 | 482/142 |
| 5,221,246 | A * | 6/1993 | Torii | A63B 21/00054 | 482/121 |
| 5,569,141 | A * | 10/1996 | Chou | A63B 21/00047 | 482/40 |
| 6,090,024 | A * | 7/2000 | Tsou | A63B 21/4033 | 482/148 |
| 8,172,737 | B1 * | 5/2012 | Nihlman | A63B 69/0064 | 606/240 |
| 9,272,174 | B2 * | 3/2016 | Carter | A63B 21/4037 | |
| 9,789,346 | B1 | 10/2017 | Kime | | |
| 2012/0322622 | A1 * | 12/2012 | Davis | A63B 21/00047 | 482/38 |
| 2015/0051057 | A1 * | 2/2015 | Carter | A63B 21/4037 | 482/142 |
| 2016/0199690 | A1 * | 7/2016 | Islas | A63B 21/00047 | 482/79 |

FOREIGN PATENT DOCUMENTS

| | | | |
|---|---|---|---|
| DE | 202011002013 | U1 | 5/2011 |
| KR | 101152152 | B1 | 6/2012 |
| KR | 20160035519 | A | 3/2016 |

* cited by examiner

HANDSTAND TRAINING DEVICE

CROSS-REFERENCE TO RELATED APPLICATIONS

This Application is a National Stage Application under 35 U.S.C. § 371 of PCT Application No. PCT/DE2020/101087, filed Dec. 29, 2020, which claims priority to German Patent Application No. 10 2020 100 161.4, filed Jan. 7, 2020, the entire contents of which are incorporated by reference herein.

BACKGROUND TO THE INVENTION

Learning a handstand is a great challenge for athletes, as a variety of motor movements are required to perform it. In order to do a handstand, it is necessary to coordinate finger work, hand angle, forearm strength, shoulder angle, shoulder opening, hip angle, leg position, head tilt and gaze fixed point, for example. For this reason, a handstand requires a highly complex system of control over various muscles and body regions. People practicing a handstand almost always use a wall as a means of support, so it is mainly the feet that are supported. The wall is used to move the legs in case of loss of balance and to place both feet or one foot up against the wall for the purpose of temporary stabilisation. This has the disadvantage that the body, having come to rest, must be put in motion again by means of larger movements of the legs, whereas for the handstand itself, the smallest movements of various parts of the body are in themselves sufficient to maintain or lose balance. Special devices also exist that support the torso or the legs, with the effect of stabilising a freely held handstand. However, it is a known problem that people who train in this way can almost never hold a handstand again without these aids, as all the muscles and nerves involved are conditioned to the aforementioned aids.

SUMMARY OF THE INVENTION

The present invention was developed against the background of the prior art described above. The object of the invention is to propose a handstand training device by which the user can learn to perform a handstand and eventually maintain a freely held handstand without using any device.

This object is achieved by providing a support element for the handstand training device with a substantially vertically extending contact surface for the arm in question. During training, one hand is placed with the lower palm on a hand contact surface, or is enclosed by it, in such a way that the arm is supported against the arm contact surface of the support element. If the body and legs are accelerated upwards in a rotational movement, the arm is brought into a fixed position in the direction of the user's swing due to the static character of the contact surface, which significantly inhibits tipping over, so that the lower centre of gravity region of the user is largely fixed. The arm is held in a vertical position and rollover is safely prevented. The fact that it is not the feet, legs or back that are supported, but the arm, results in a special training effect that enables a freely held handstand to be maintained after a certain period of practice, since the user can train the body regions of the legs, hips and shoulder girdle which are primarily responsible for balance in a targeted manner without having to set them in motion unnecessarily by placing his feet up against the wall and therefore bringing them out of balance once they have been aligned with each other in a concentrated manner. The handstand training device therefore provides the user with a substitute for heavily trained forearm muscles that press the fingers against the floor surface, providing a stable foundation in the user's lower centre of gravity area rather than providing stabilisation in the upper centre of gravity area of the hips, legs and back.

Advantageous embodiments of the invention with non-limiting additional features are described below.

The base element can be a stand that can be placed on a floor, for example, which has a contact surface for a hand that is also essentially horizontal in relation to the horizontal plane of the floor.

The base element can also be designed as a fastening element for an external item of sports equipment, which in particular has a bar. The bar then forms the contact surface for the hand that grips the bar. This allows the handstand training device to be used on other diverse items of sports equipment that are not part of the invention. Fixation on bars parallel to the surface of the floor allows various forms of exercise to be carried out on these or on parallel bars. For example, the gymnast can perform handstand push-ups or other exercises where the arm support is not only fixed vertically but at any angle that can be rotated around the bars, allowing adjustment to a changing arm angle relative to the arm support.

The training device is designed in such a way that during a handstand, the body weight force is transferred from the hand to the hand contact surface and thus the base element or stand or the item of sports equipment is kept stable on the floor even when the force of the arm is acting on the support element.

At least one pillar is attached to the base element, which is essentially vertical in relation to the floor or the hand contact surface, and on which the support element is arranged. During use, the fingers of the hand placed on the palm contact surface, with the exception of the thumb, point in the direction of the pillar.

A spacer is provided between the pillar and the support element which is arranged substantially orthogonally with respect to the pillar.

The spacer has a guide element and the pillar has a complementary guide, so the spacer is designed to be movable along the pillar and therefore adjustable in height. This allows the arm to be supported in different areas, for example in the area of the forearm down to the wrist or in the area of the upper arm. By successively reducing the height of the spacer, the user can accustom his nervous system to a reduced support effect that allows him to become independent of the device. Unlike practising with a wall, it is possible to quickly achieve gradual release from support and free holding of a handstand without any training device.

The spacer can be designed to be adjustable in length and, in particular, telescopically extendable and retractable and/or lockable. This allows the position of the support element to be adapted to the user's anatomy or their finger length, which results in a different position of the hand on the hand contact surface and therefore a variation in the distance between the arm and the support element.

The pillar has a scale for adjusting the height. In this way, the support elements can be adjusted to the same height when using two training devices, one for each arm.

In a further embodiment, the handstand training device is formed in a single piece and is manufactured, for example, by injection moulding. This makes the training device particularly compact and its production very cost-effective.

In another embodiment, two spaced pillars are provided and the support element is arranged between the two pillars, preferably so as to be adjustable in height.

The support element is attached to a horizontally running retaining element, which is designed, for example, as a strip or crosspiece and runs essentially horizontally. The two ends of the retaining element are each removably attached to one of the two pillars (15).

Several hook-shaped recesses are provided for fastening the retaining element to the pillars in which the retaining element can be hooked in at the desired height.

The stand has an anti-slip structure or coating on the underside and/or the contact surface for the hand.

The invention further comprises a set of two handstand training devices having the combinations of features described above for the use of both hands or the support of both arms. The handstand training devices are placed next to each other accordingly when in use.

BRIEF DESCRIPTION OF THE DRAWINGS

In detail, the figures show the following.

Functionally identical elements bear the same reference numerals.

DETAILED DESCRIPTION OF PREFERRED EMBODIMENTS

Figure 1:
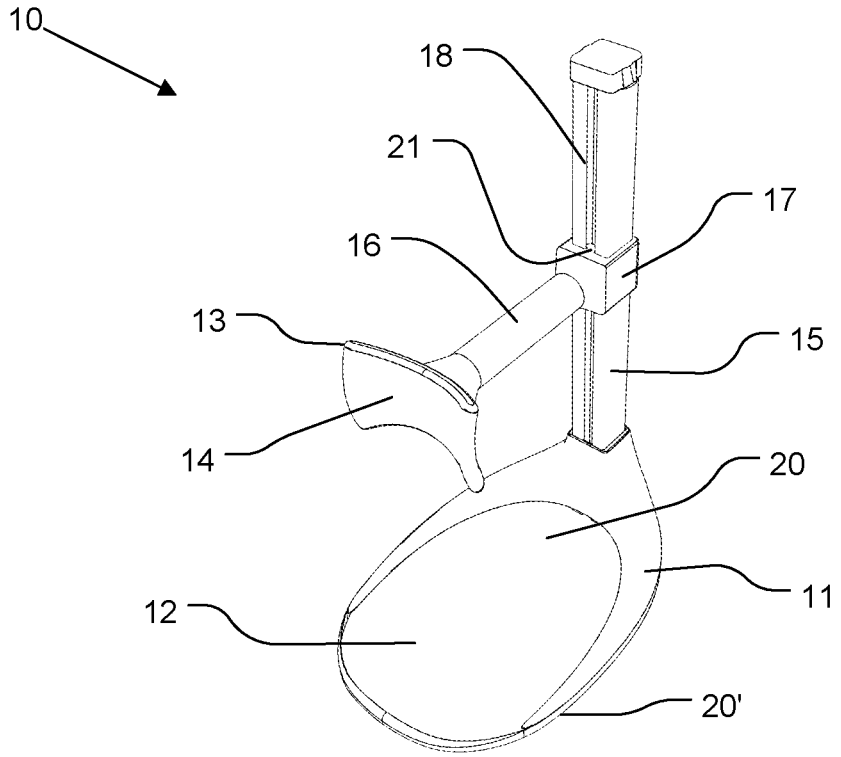
FIG. 1 a perspective view of the handstand training device from the side and front.

In the following, exemplary embodiments of the invention are described in detail with reference to the drawings, whereby further advantageous features are shown in the drawings.

FIG. 1 shows a view of the handstand training device 10 from a front and side perspective. The lower base of the handstand training device 10 is a stand 11 that can be placed on the floor. To prevent slipping when performing exercises, a rubber anti-slip coating 20 is provided on its underside. On the upper side, the stand 11 has an approximately oval, horizontal contact surface 12 for a right or left hand, whereby this is also covered with a non-slip coating 20.

A vertical pillar 15 with an approximately square cross-section is attached to the rear end of the stand 11, i.e. the pillar 15 has the shape of a square profile. The pillar 15 has a groove 18 that is vertical or parallel to its longitudinal axis which serves as a guide for a guide element 17.

The guide element 17 is attached to the pillar 15 in a continuously vertically movable manner. It has a cube-like outer shape. A corresponding bung 21 is attached to the guide element 17, which engages in the groove 18. The guide element 17 encloses a region of the four surfaces of the square pillar 15, which thereby serve as additional guides. This allows the guide element 17 to be moved up and down and still be securely attached to the pillar 15.

A horizontal spacer 16 is attached to the guide element 17 with its rear end. The support element 13 for the arm is attached to the opposite front end of the spacer 16. The support element 13 comprises an arm contact surface 14 which is substantially vertical in relation to the floor and is concavely curved to conform to the shape of a resting arm.

Figure 2:
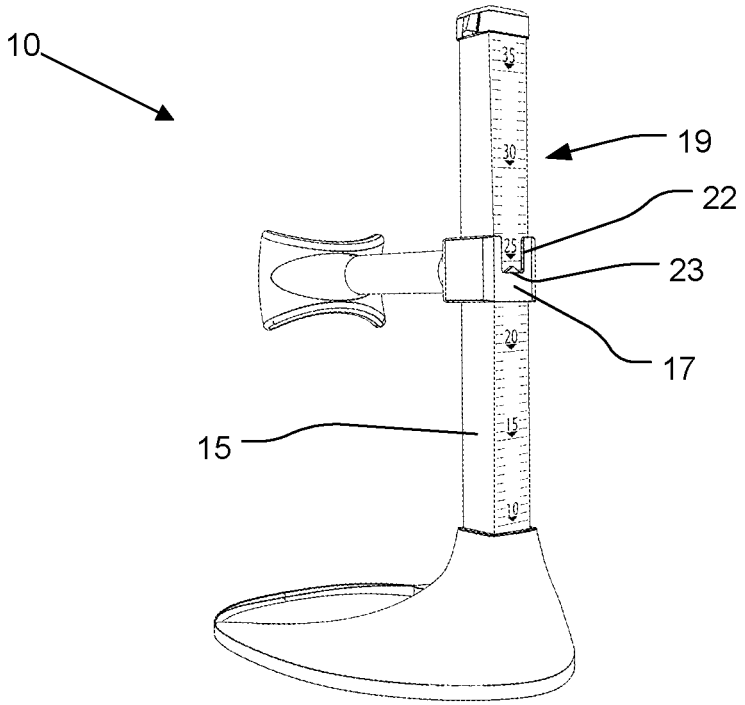
FIG. 2 a perspective view of the handstand training device from the side and rear.

FIG. 2 shows a perspective view of the handstand training device from the side and rear. It is shown that the pillar 15 has a scale 19 at the rear for adjusting the support element 13 to a defined height. For adjustment purposes, a slot 22 with a pointer 23 is provided on the back of the guide element 17.

Figure 3A:
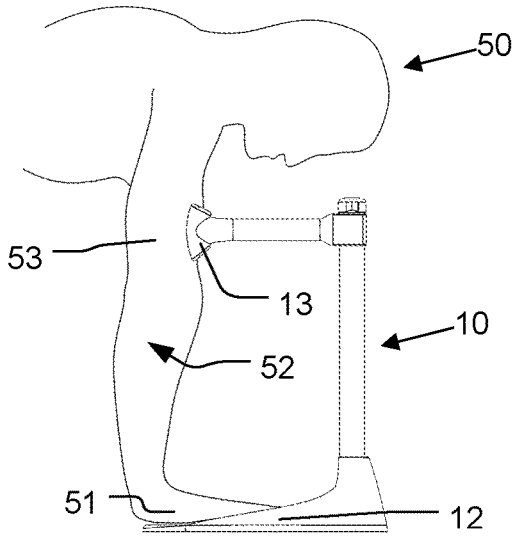
FIG. 3*a* a side view of the handstand training device with the support element in an upper position and a user.
Figure 3B:
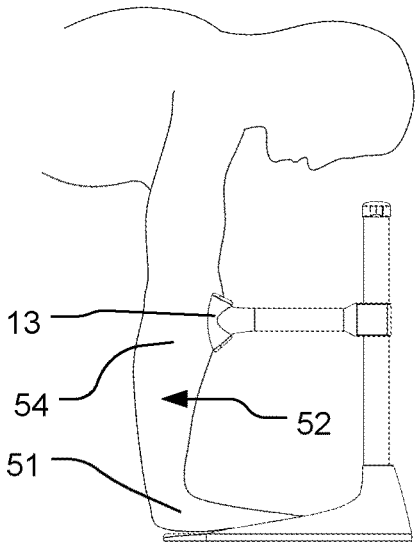
FIG. 3*b* a side view of the handstand training device with the support element in a central position and a user.
Figure 3C:
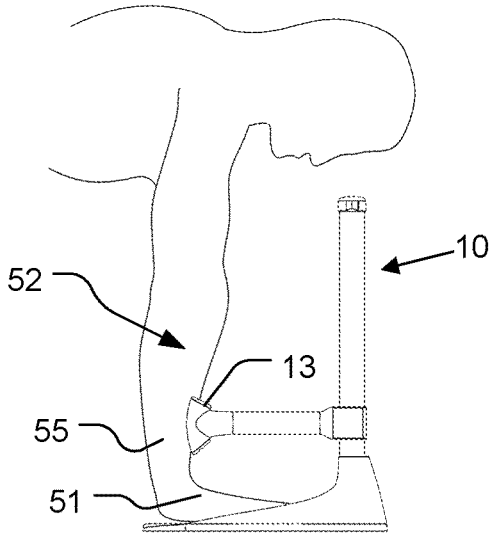
FIG. 3*c* a side view of the handstand training device with the support element in a lower position and a user.

FIGS. 3*a* to 3*c* show a side view of the handstand training device 10 and a user 50, each figure showing the support element 13 set at a different height. As the height of the support element 13 is infinitely adjustable, all intermediate positions (not shown) can also be set. The user 50 is shown in each case in the initial phase of a handstand, with their upper body still in a horizontal position. Their hand 51 rests on the hand contact surface 12. This transfers the body weight force from the hand 51 to the hand contact surface 12 and presses the stand down onto the floor. As a result, despite the force of the arm 52 acting on the support element 13, the training device 10 is kept stable on the floor and cannot tip over.

In FIG. 3*a* the support element 13 is pushed to the uppermost position. This supports the upper arm 53. This setting is particularly suitable for beginners, as the leverage of the arm 52 provides the greatest support.

FIG. 3*b* shows the support element 13 in a middle position in which the arm 52 is supported in the area of the arm joint. This setting is suitable for advanced users 50 as the support effect is in the medium range.

FIG. 3*c* shows the support element 13 in the lowest position, in which the arm 52 is supported in the area of the wrist. This setting is suitable for very advanced users 52 as the support effect here is only slight. If the user can confidently perform a handstand in the lowest position shown in FIG. 3*c*, a free handstand without any device can then be practised in the final training phase. It is also possible to train initially with a set of two devices 10, one for each arm 52, then with only one device 10 for one arm 52, and finally freely.

Figure 4:
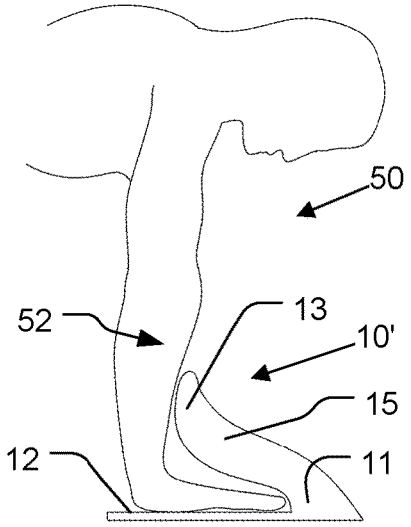
FIG. 4 a side view of a second embodiment of the handstand training device with a user.

FIG. 4 shows a side view of a second embodiment of the handstand training device 10 with a user 50. This embodiment 10 is formed in a single piece. Like the previously shown embodiment 10, it has a stand 11 with a hand contact surface 12. However, the stand 11 merges directly into an S-shaped curved pillar 15 and a terminal support element 13.

Figure 5:
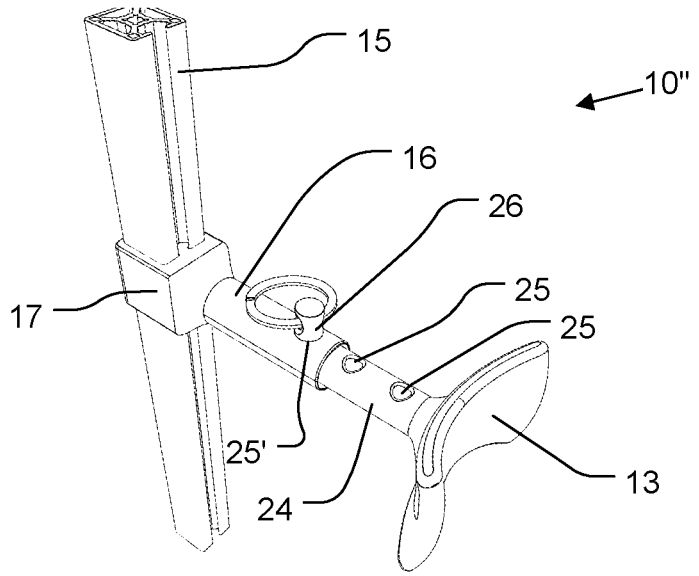
FIG. 5 a detailed perspective view of a third embodiment of the handstand training device.

FIG. 5 shows a detailed perspective view of a third embodiment of the handstand training device 10. As in FIG. 1, the vertical pillar 15 is shown with the guide element 17, the horizontal spacer 16 and the support element 13. For this purpose, the spacer 16 is hollow. A pull-out element 24 is movably arranged in the cavity. Several spaced openings 25 are provided in the pull-out element 24. The spacer 16 has an opening 25 in the end region. The pull-out element 24 can be fixed in a position where one of its openings 25 coincides with the opening 25 in the spacer 16 by inserting a pin 26 through both openings. The spacer 16 is thereby adjustable in length so that the distance of the support element 13 from the pillar 15 can be altered. The number of adjustment positions corresponds to the number of holes 25 in the pull-out element 24.

Figure 6:
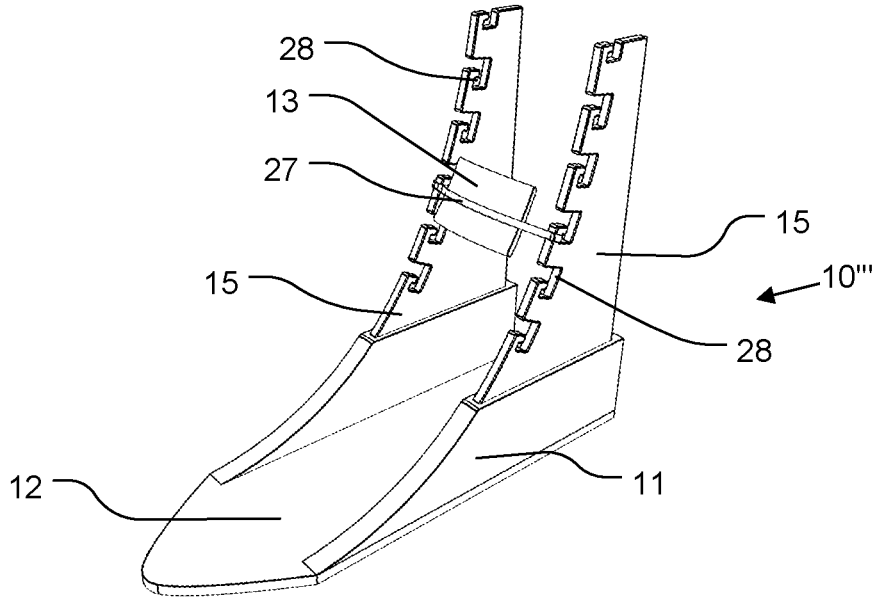
FIG. 6 a perspective view of a fourth embodiment of the handstand training device.

FIG. 6 shows a perspective view of a fourth embodiment of the handstand training device 10. Like the other embodiments, this also has a stand 11 that can be placed on the floor with a horizontal contact surface 12 for a right or left hand 51 and a support element 13. However, instead of one pillar 15, two vertical pillars 15 are attached to the stand 11 at a certain distance apart, with the support element 13 arranged between the two pillars. This is attached to a horizontally running strip 27, the two ends of which are each removably attached to a pillar 15. In order to fasten the strip 27, several hook-shaped recesses 28 are provided on the pillars 15, to which the strip 27 can be fastened at the desired height.

Figure 7:
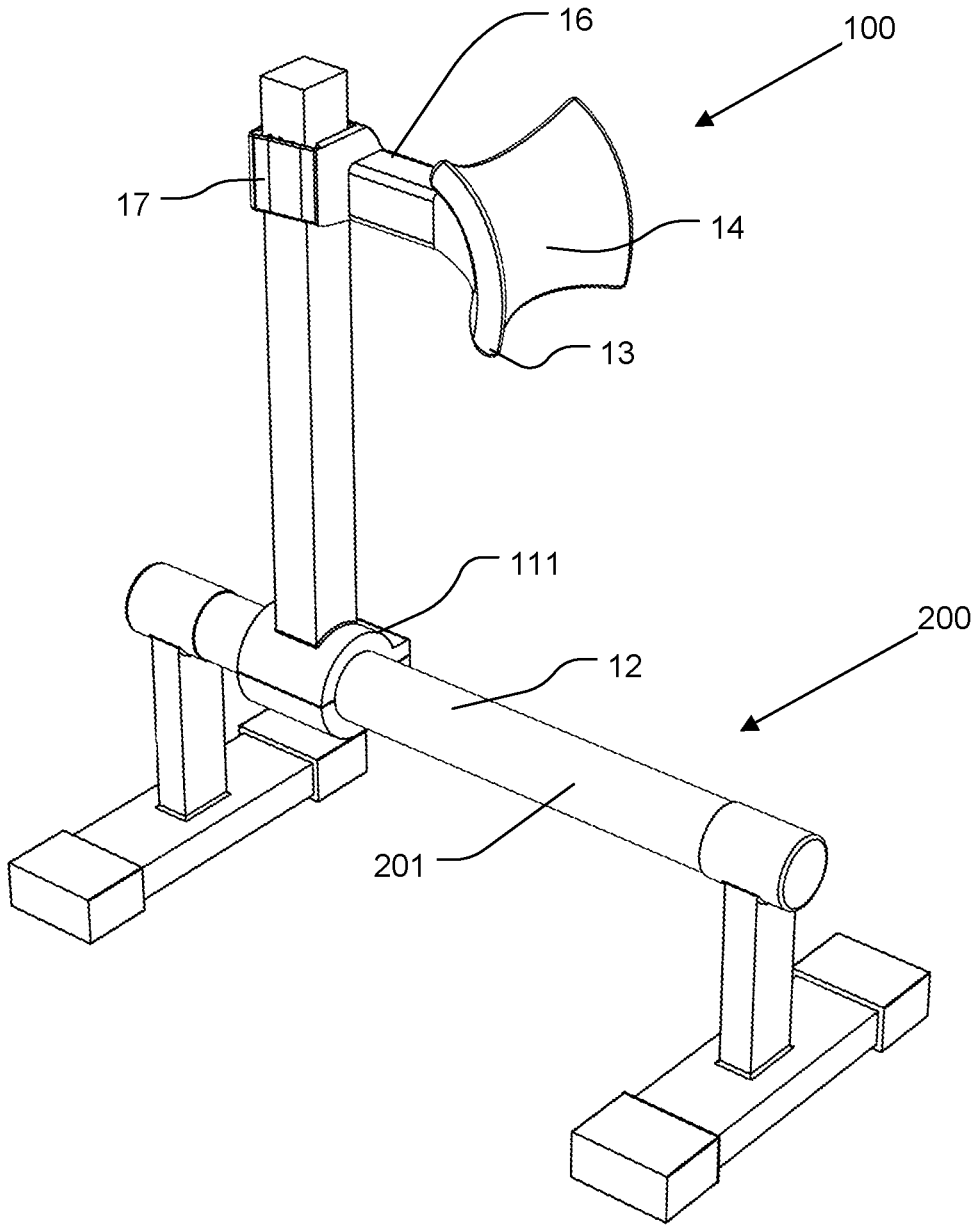
FIG. 7 a perspective view of a fifth embodiment of the handstand training device.

FIG. 7 shows a perspective view of a fifth embodiment of the handstand training device 100. The upper portion of this embodiment 100 is substantially the same as the upper portion of the handstand training device 10 shown in FIG. 1. This comprises the vertical pillar 15 with the guide element 17, which is vertically movably attached to the pillar 15. On the guide element 17 is the horizontally extending spacer 16 with the support element 13 and its arm contact surface 14.

The lower base element is a fastening element 111 for an external item of sports equipment 200. The item of sports equipment 200 has a round bar 201 which forms the contact surface 12 for a hand 51 (not shown). The base element or fastening element 111 is designed as a clamp that grips around the bar 201 and in this way fixes the handstand training device 100 to the item of sports equipment 200.

LIST OF REFERENCE NUMERALS

10. Handstand training device
11. Stand
12. Hand contact surface
13. Support element
14. Arm contact surface
15. Pillar
16. Spacer
17. Guide element
18. Guide
19. Scale
20. Coating
21. Guide bung
22. Slot
23. Pointer
24. Pull-out element
25. Openings
26. Pin
27. Strip
28. Recesses
50. Person
51. Hand
52. Arm
53. Upper arm
54. Arm joint
55. Forearm
100. Handstand training device
111. Fastening element
200. Item of sports equipment
201. Bar

The invention claimed is:

1. A handstand training device (10, 100) comprising a base element (11, 111), a support element (13) having a contact surface (14) configured to support an arm (52) pressed thereagainst, at least one pillar (15) upstanding from and fastened to the base element (11, 111), and, an elongated spacer (16) extending along a longitudinal axis between the at least one pillar (15) and the support element (13), the longitudinal axis being;

i. substantially orthogonal with respect to the at least one pillar (15) and aligned to intersect therewith, and ii. aligned to intersect with, and be transverse to, the contact surface (14), wherein the spacer (16) includes a guide element (17) and the at least one pillar (15) includes a complementary guide (18), the guide element (17) and the complementary guide (18) configured to collectively allow the spacer (16) to be vertically movable along the pillar (15) so as to be adjustable in height relative to the base element (11, 111).

2. The handstand training device (10) according to claim 1, wherein the base element is designed as an erectable stand (11) with a secondary contact surface (12) configured to support a hand (51) pressed thereagainst.

3. The handstand training device according to claim 2, wherein at least one of the stand (11) and the secondary contact surface (12) has an anti-slip structure (20) or coating (20).

4. The handstand training device (10, 100) according to claim 3, wherein the anti-slip structure (20) or coating (30) is located on an underside of the stand (11).

5. The handstand training device (10, 100) according to claim 2, wherein the handstand training device (10, 100) is designed in such a way that, during a handstand by a user of the handstand training device (10, 100), body weight force transmitted from the hand (51) of the user to the secondary contact surface (12) stably holds the stand (11) on a floor with the arm (52) of the user pressing against the support element (13).

6. The handstand training device (100) according to claim 1, wherein the base element is designed as a fastening element (111) for an external item of sports equipment (200) which has a bar (201) and the bar (201) forms a secondary contact surface (12) for a hand (51).

7. The handstand training device (10, 100) according to claim 6, wherein the handstand training device (10, 100) is designed in such a way that, during a handstand by a user of the handstand training device (10, 100), body weight force transmitted from the hand (51) of the user to the secondary contact surface (12) stably holds the item of sports equipment (200) on a floor with the arm (52) of the user pressing against the support element (13).

8. The handstand training device (10, 100) according to claim 3, wherein the secondary contact surface (12) has an anti-slip structure (20) or coating (20).

9. The handstand training device (10, 100) according to claim 1, wherein the spacer (16) is adjustable in length.

10. The handstand training device (10, 100) according to claim 1, wherein the pillar (15) has a scale (19) for adjusting the support element (13) to a defined height.

11. The handstand training device (10, 100) according to claim 1, wherein the pillar (15) is substantially vertically extending.

* * * * *